US007556255B2

(12) United States Patent
Terashima et al.

(10) Patent No.: US 7,556,255 B2
(45) Date of Patent: Jul. 7, 2009

(54) IMAGE PROCESSING APPARATUS

(75) Inventors: Hideyuki Terashima, Kawasaki (JP); Yoshiaki Suzuki, Kawasaki (JP); Takashi Awai, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 11/139,522

(22) Filed: May 31, 2005

(65) Prior Publication Data

US 2005/0286942 A1 Dec. 29, 2005

(30) Foreign Application Priority Data

Jun. 23, 2004 (JP) ..... 2004-184537

(51) Int. Cl.
*B65H 3/44* (2006.01)

(52) U.S. Cl. ..... 271/9.07; 271/9.08

(58) Field of Classification Search ..... 271/9.07, 271/9.08

See application file for complete search history.

(56) References Cited

U.S. PATENT DOCUMENTS

| | | | | |
|---|---|---|---|---|
| 4,429,863 | A | 2/1984 | Itoh et al. | 271/9 |
| 4,855,790 | A | 8/1989 | Suzuki | 355/24 |
| 4,896,871 | A | 1/1990 | Idenawa | 271/9 |
| 4,998,121 | A | 3/1991 | Koh et al. | 346/160 |
| 5,027,160 | A | 6/1991 | Okada et al. | 355/282 |
| 5,043,763 | A | 8/1991 | Koh et al. | 355/206 |
| 5,083,168 | A | 1/1992 | Kusaka et al. | 355/285 |
| 5,118,920 | A | 6/1992 | Tanabe et al. | 219/216 |
| 5,153,655 | A | 10/1992 | Suzuki et al. | 355/285 |
| 5,157,444 | A | 10/1992 | Mori et al. | 355/282 |
| 5,162,634 | A | 11/1992 | Kusaka et al. | 219/216 |
| 5,179,263 | A | 1/1993 | Koh et al. | 219/216 |
| 5,196,675 | A | 3/1993 | Suzuki et al. | 219/216 |

(Continued)

FOREIGN PATENT DOCUMENTS

DE 31 35 751 A1 4/1982

(Continued)

OTHER PUBLICATIONS

Official Letter/Search Report, issued by The Intellectual Property Office of the People's Republic of China on Dec. 29, 2006, in Chinese Application No. 2005100774677.

(Continued)

*Primary Examiner*—Patrick H Mackey
*Assistant Examiner*—Howard Sanders
(74) *Attorney, Agent, or Firm*—Fitzpatrick, Cella, Harper & Scinto

(57) ABSTRACT

The typical configuration of an image processing apparatus includes a document stacking means on which documents are stacked, a recording medium stacking means on which recording medium are stacked, and a feeding roller for feeding documents or recording medium from the document stacking means or the recording medium stacking means. The feeding roller is located above the recording medium stacking means, and at least the lower end of the recording medium stacking means is movable in the direction approaching or moving away from the feeding roller. The document stacking means is attached above and substantially parallel to the recording medium stacking means, at a predetermined interval. Further, the document stacking means does not have a support portion at a location corresponding to the feeding roller, and is moved as the recording medium stacking means is moved.

11 Claims, 10 Drawing Sheets

U.S. PATENT DOCUMENTS

| | | | | | |
|---|---|---|---|---|---|
| 5,225,874 | A | | 7/1993 | Koh et al. | 355/285 |
| 5,300,999 | A | | 4/1994 | Koh et al. | 355/289 |
| 5,448,268 | A | | 9/1995 | Cho | 346/134 |
| 5,533,821 | A | | 7/1996 | Awai et al. | 400/619 |
| 5,592,280 | A | | 1/1997 | Ishizuka et al. | 399/410 |
| 5,633,704 | A | | 5/1997 | Suzuki et al. | 399/69 |
| 5,651,623 | A | * | 7/1997 | Stodder et al. | 400/605 |
| 5,727,890 | A | * | 3/1998 | Stodder et al. | 400/624 |
| 5,729,791 | A | | 3/1998 | Kutsuwada et al. | 399/82 |
| 5,738,454 | A | | 4/1998 | Zepeda et al. | 400/625 |
| 5,745,661 | A | | 4/1998 | Koh et al. | 395/113 |
| 5,913,099 | A | | 6/1999 | Kamei et al. | 399/296 |
| 5,940,543 | A | | 8/1999 | Isemura et al. | 382/284 |
| 6,022,013 | A | * | 2/2000 | Foglino et al. | 271/9.08 |
| 6,113,093 | A | | 9/2000 | Morinaga et al. | 271/162 |
| 6,227,533 | B1 | * | 5/2001 | Jang | 271/109 |
| 6,315,280 | B1 | * | 11/2001 | Jang | 271/9.02 |
| 6,385,406 | B1 | | 5/2002 | Funamizu et al. | 399/16 |
| 2004/0130089 | A1 | | 7/2004 | Suzuki et al. | 271/9.01 |

FOREIGN PATENT DOCUMENTS

| | | |
|---|---|---|
| EP | 0 783 975 A2 | 7/1997 |
| JP | 3-243545 | 10/1991 |
| JP | 7-181763 | 7/1995 |

OTHER PUBLICATIONS

Official Letter/Search Report, issued Oct. 20, 2008, by the European Patent Office, in European Application No. 05012230.8.

Official Letter/Search Report, issued Feb. 5, 2009, by the European Patent Office, in European Application No. 05012230.8.

* cited by examiner

IMAGE PROCESSING APPARATUS

BACKGROUND OF THE INVENTION

1. Field of the Invention

The present invention relates to the configuration of an image processing apparatus, such as a facsimile machine, that includes a common conveyance path used for both a document and a recording medium.

2. Related Background Art

An image processing apparatus, such as a facsimile machine wherein part of a conveyance path is employed in common for both a document and a recording medium, has been proposed for size and cost reduction purposes.

One example of such a configuration is shown in FIG. 11. The image processing apparatus in FIG. 11 comprises: an ASF unit 301, for separating and individually conveying recording medium in a stack stacked on a stacking tray; an ADF unit 302, for separating and individually conveying document sheets in a stack stacked therein; an auxiliary convey roller 303, for conveying a recording medium or a document conveyed by the ASF unit 301 or the ADF unit 302; a main convey roller 304, for conveying a recording medium or a document at a predetermined velocity; a delivery roller 305, for the delivery, outside the apparatus, of a recording medium or a document; a scanner 306, for reading data from a document; and a recording unit 307, for forming an image on a recording medium. In this configuration, the auxiliary convey roller 303, the main convey roller 304, the delivery roller 305 and a guide member, which together form a conveyance path, are commonly employed for a document and a recording medium, so as to attain a reduction in the size and the cost of the image processing apparatus. The thus arranged facsimile machine is proposed in U.S. Pat. No. 5,727,890, for example.

Another configuration has been proposed wherein the rotation and the revolution of a single feeding roller are controlled for the feeding of recording medium, received from a sheet cassette, through a manual paper port (Japanese Patent Laid-Open Application No. H03-243545). According to the arrangement disclosed in Japanese Patent Laid-Open Application No. H03-243545, a feeding roller can be rotated and moved between two recording medium stacking means, so that recording medium can be fed by either stacking means.

In the structure disclosed in U.S. Pat. No. 5,727,890, the scanner 306 is located upstream of the main convey roller 304, and the auxiliary convey roller 303 is arranged so as to support, for the ADF unit 302, an unstable conveying velocity used to convey the document to the main convey roller 304. However, compared with another conveying means and a conveyance path that are employed to convey a document and a recording medium, merely the delivery roller 305 is employed in common, and the reduction in the size and the cost of the apparatus is unsatisfactory.

In the structure disclosed in Japanese Patent Laid-Open Application No. H03-243545, the mechanism and control process for rotating the feeding roller are complicated, and separation means must be provided for each stacking means. Therefore, the reduction in the size and the cost of the apparatus is also unsatisfactory.

SUMMARY OF THE INVENTION

The objective of the present invention is, therefore, to provide an image processing apparatus wherein, to reduce the size and the cost of the apparatus, a single set of separation feeding mechanisms is provided to enable the separate feeding of a document and a recording medium, and whereby especially smooth feeding can be performed.

To achieve this objective, a typical configuration, for an image processing apparatus according to this invention comprises: document stacking means, on which documents are to be stacked, a recording medium stacking means, on which recording medium are to be stacked, and a feeding roller that feeds, from the document stacking means and the recording medium stacking means, a document and a recording medium, is located above the recording medium stacking means; wherein, at the least, a lower end of the recording medium stacking means is movable, in a direction approaching or moving away from the feeding roller, and the document stacking means is located above and parallel to the recording medium stacking unit, at a predetermined interval; and wherein the document stacking means does not have a support portion at a location corresponding to the feeding roller and is moved as is the recording medium stacking means.

According to the invention, since the feeding roller, the separation unit and the conveyance path for separating and conveying the document and the recording medium can be employed in common for the image processing apparatus, which includes reading means and recording means, the size and the cost of the apparatus can be reduced. Furthermore, although these components are employed in common, back tension during and after feeding can be eliminated, and the lower face of the document can be stably supported.

DESCRIPTION OF THE PREFERRED EMBODIMENT

The embodiment of the present invention will now be described in detail while referring to the accompanying drawings. However, as to the scope of the invention, the sizes, materials, shapes and relative positions of the components are not limited to those described in this embodiment, unless especially so designated.

Figure 1:
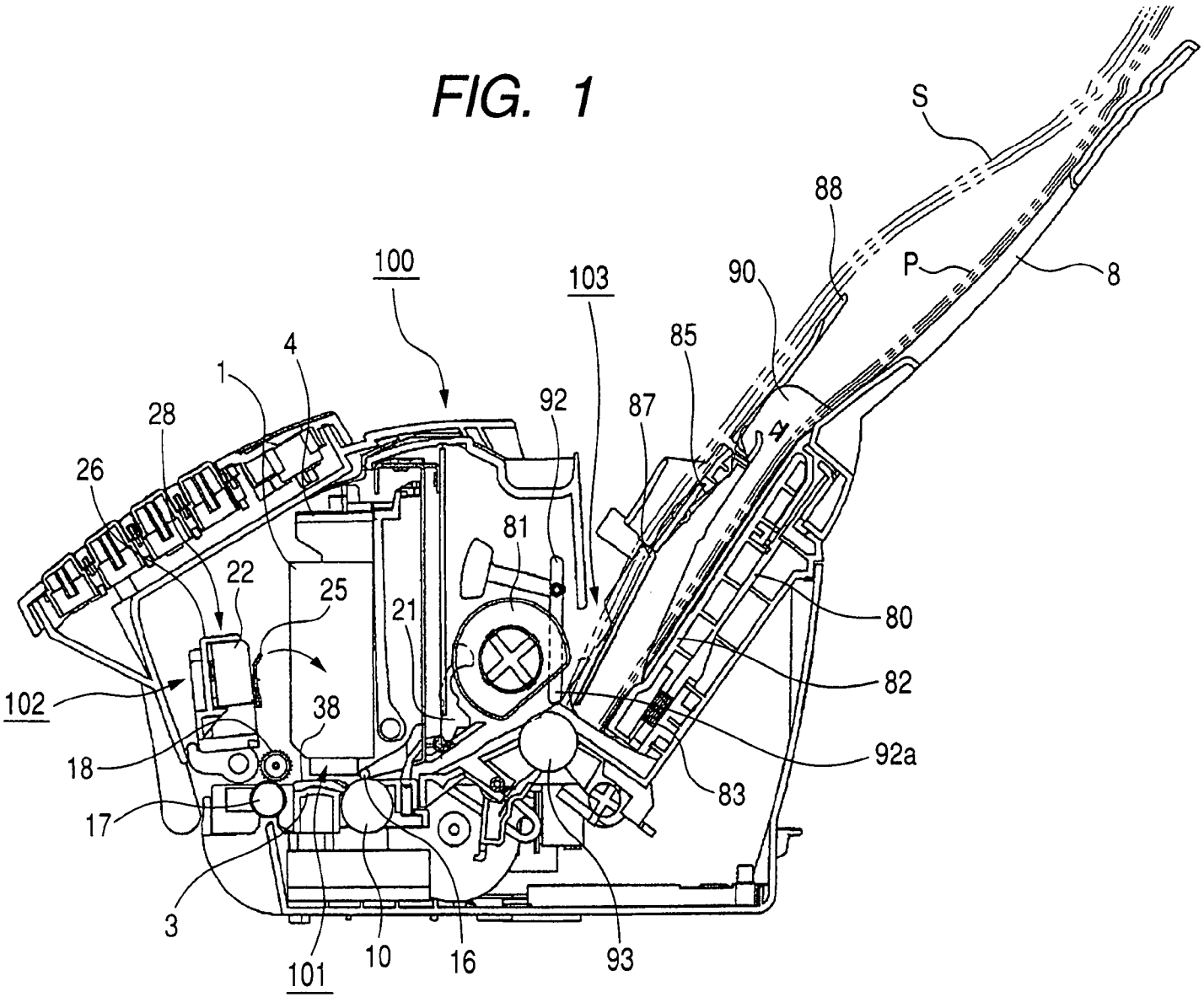
FIG. 1 is a cross sectional view of the configuration of an image processing apparatus according to one embodiment of the present invention.

FIG. 1 is a cross sectional view of the configuration of an image processing apparatus according to the embodiment of the present invention, using a facsimile machine as an example. A facsimile machine 100 in FIG. 1 comprises: an image recording unit 101, including a cartridge 1, that is a recording means example; an image reading unit 102, including an image reader 28, that is a reading means example; and an automatic feeder 103, which separates a plurality of recording medium P, or a plurality of documents S, and feeds each recording medium P or each document S that has been set for the image recording unit 101 or the image reading unit 102.

Downstream of the automatic feeder 103, there are a PageEnd sensor lever (PE sensor lever) 21, for detecting a recording medium P or a document S, a conveying unit, for conveying a sheet to the image recording unit 101 and to the image reading unit 102 at a predetermined velocity, and a delivery unit, for delivering, to an external location, a sheet that has been recorded and scanned. The conveying unit includes: a convey roller 10, which is made of a metal shaft and a rubber roller; and a plurality of pinch rollers 16, which are pressed against the convey roller 10 in a crosswise direction, relative to a sheet. The delivery unit includes: a delivery roller 17, obtained by integrally forming an elastomer with a plastic shaft; and a spur 18, pressed against the delivery roller 17. A platen 3 is provided as a sheet passage surface extending from an ASF base 80 to the delivery roller 17. A plurality of ribs 38 are formed on the recording medium support face of the platen 3 in the crosswise direction relative to the recording medium, and during the recording medium conveying process, the recording medium P is passed by the upper faces of the ribs 38. As is described above, the conveyance path from a feeding roller 81 to the delivery roller 17 is a common conveyance path along which both a document and a recording medium are passed.

The image recording unit 101 is an ink jet recording type for discharging ink, from the ink cartridge 1, to record data. The cartridge 1 is mounted on a carriage 4, and scans a document in a crosswise direction perpendicular to the direction in which the recording medium P is conveyed. According to this embodiment, the present invention is applied for a serial type recording apparatus that moves a recording head in the main scanning direction. It should be noted, however, that the present invention can also be applied for a full-line type recording apparatus that records images by employing a recording head extending across the entire area, in the crosswise direction relative to a recording sheet, while recording sheets are sequentially conveyed.

The image reader 28 of the image reading unit 102 includes: a contact image sensor (hereinafter referred to as a CS) 22, which is image reading means; a CS holder 26, which is a member for holding the CS 22; and a white reference member 25, which is held by the CS holder 26 in a state wherein it is opposite the CS 22. The image reader 28 is normally at a wait position, separate from the platen 3 (a standby state). When the main body of the apparatus receives an image reading instruction, such as a copy instruction or a transmission instruction, the image reader 28 is rotated by drive means (not shown) in a direction indicated by an arrow in FIG. 1, and is moved to a reading position opposite the platen 3 (a reading state). Since the image reader 28 is arranged on the route along which the carriage 4 is moved, the entire size of the facsimile machine can be reduced. During the image recording operation, as shown in FIG. 1, the image reader 28 is moved to a wait position outside the area to which the carriage 4 is moved, so that the image reader 28 does not interfere with the space for moving the carriage 4.

The document S fed to the image reading unit 102 is conveyed to the image reader 28 by the convey roller 10 and the pinch roller 16, which are used in common for the recording medium P. Then, the image reader 28 scans the document S as the document S is pinched and conveyed by the convey roller 10 and the pinch-roller 16, as well as by the delivery roller 17 and the spur 18, and thereafter, the document S is delivered, outside the apparatus.

Figure 2:
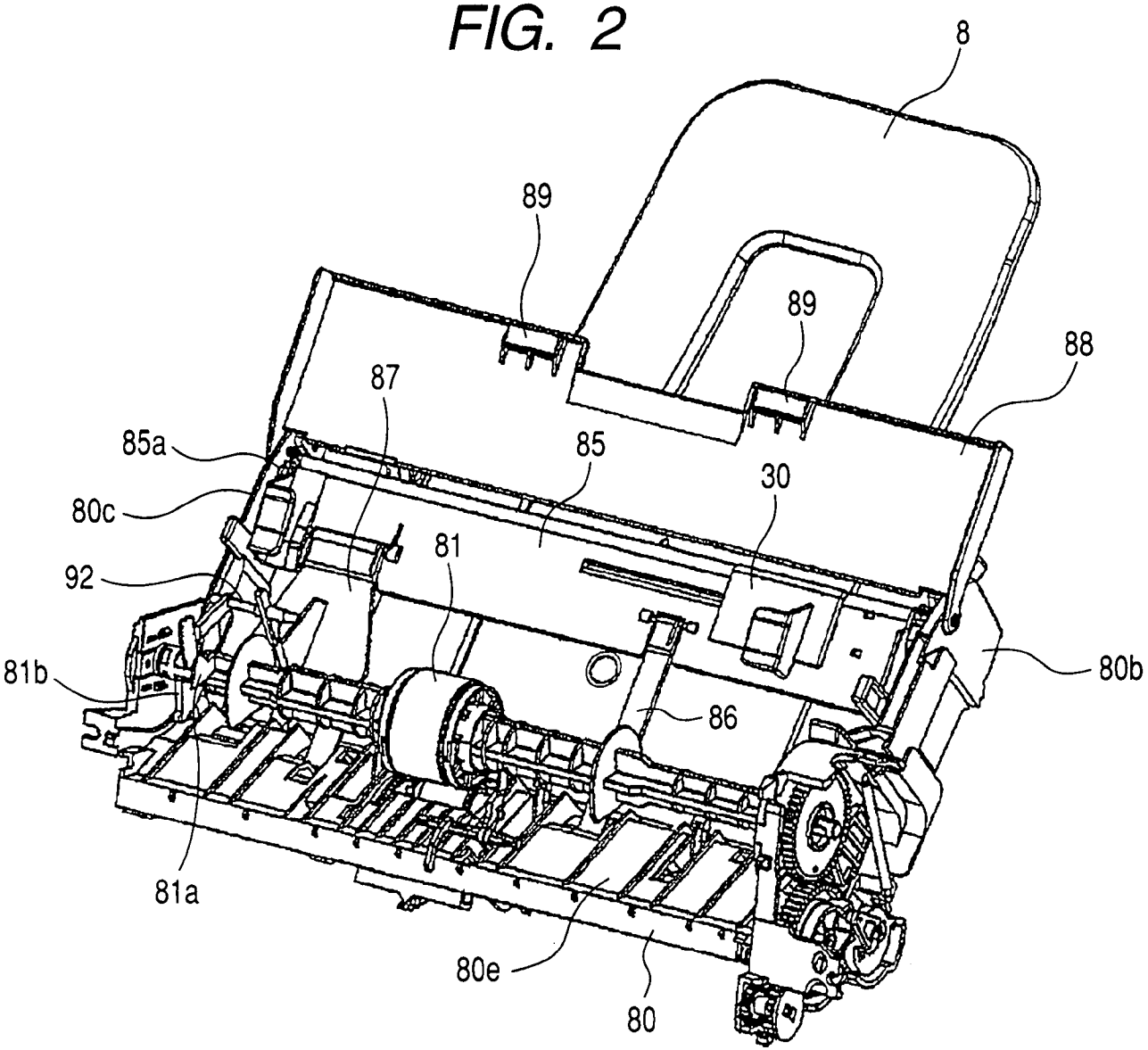
FIG. 2 is a perspective view of an automatic feeder wherein documents and recording medium are not set.
Figure 3:
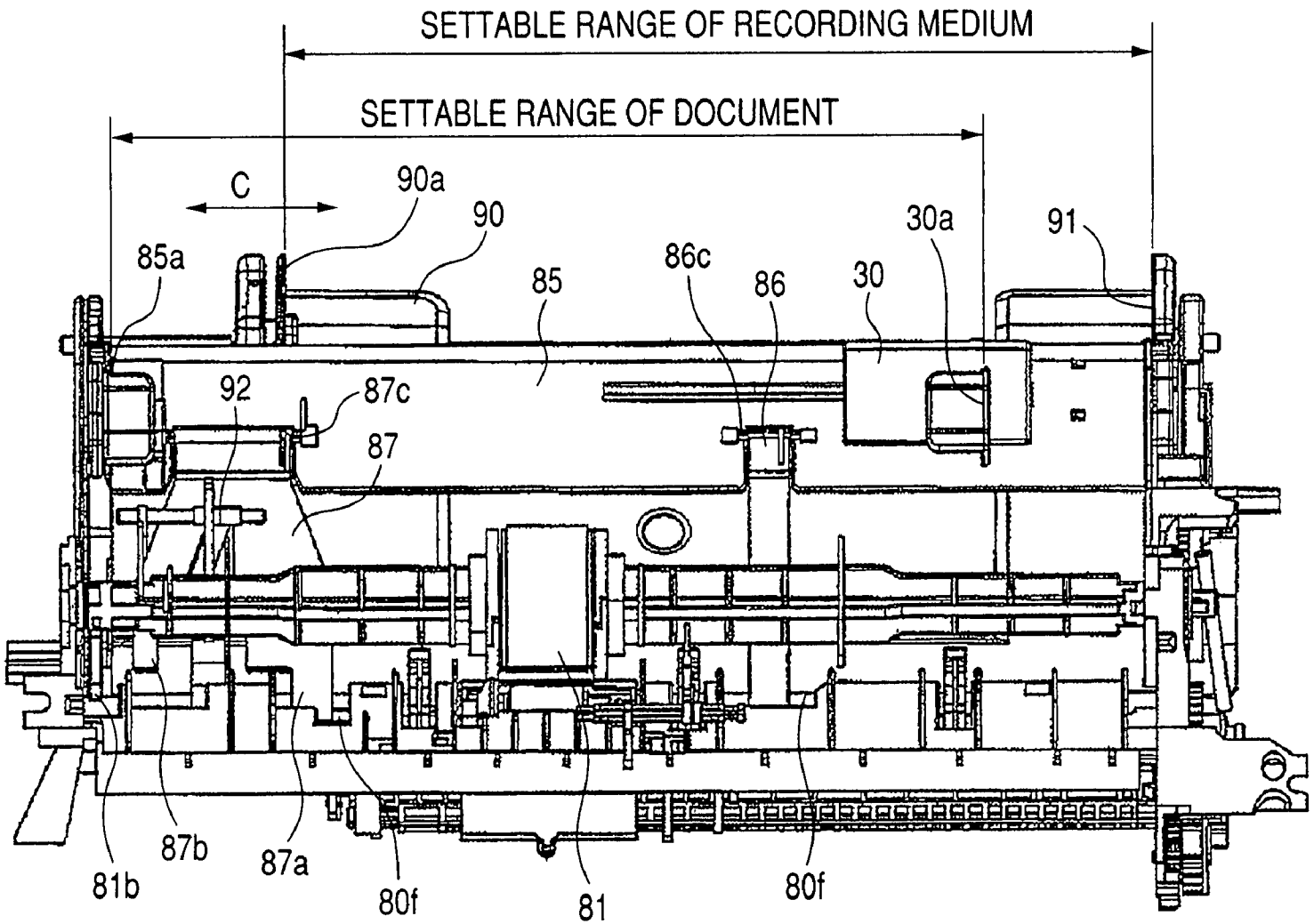
FIG. 3 is a front view of the automatic feeder wherein documents and recording medium have not been set.
Figure 4A:
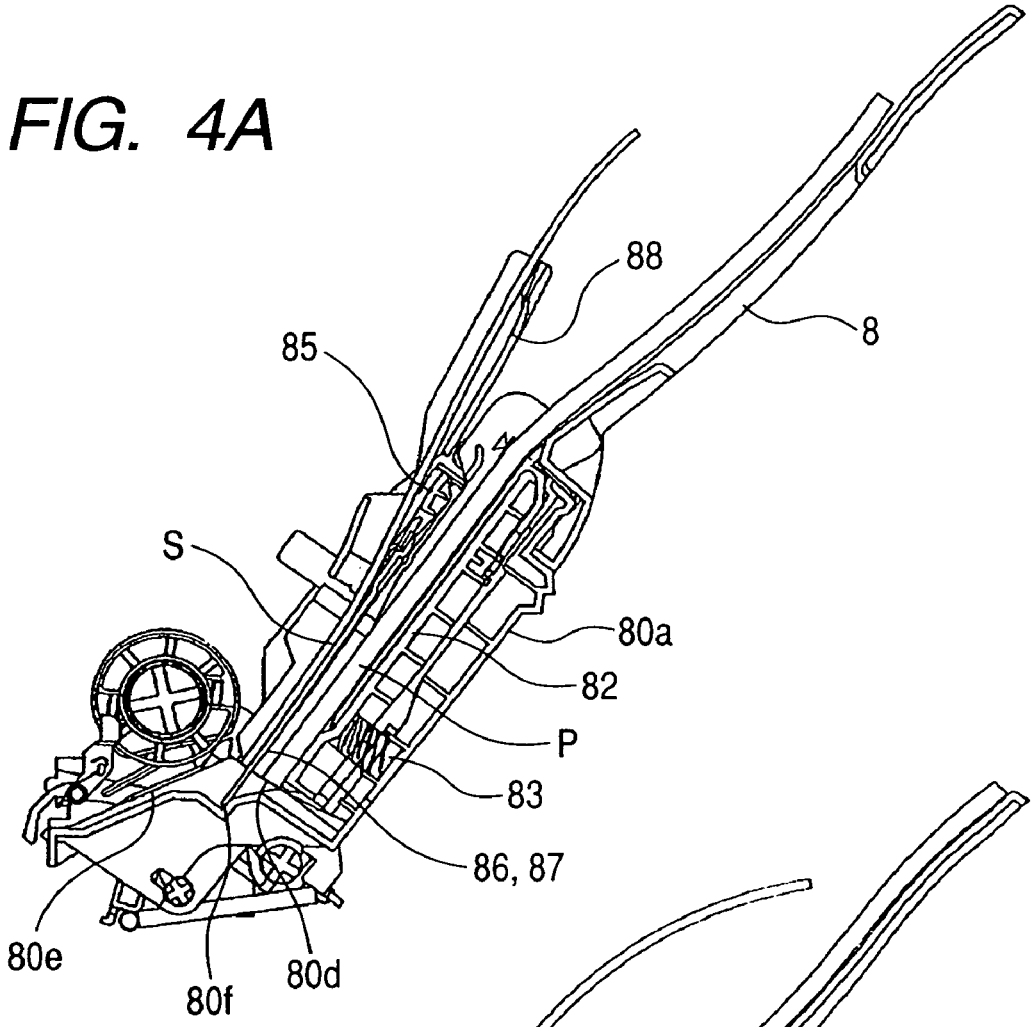
FIGS. 4A and 4B are cross sectional views of the states wherein only documents have been set.
Figure 4B:
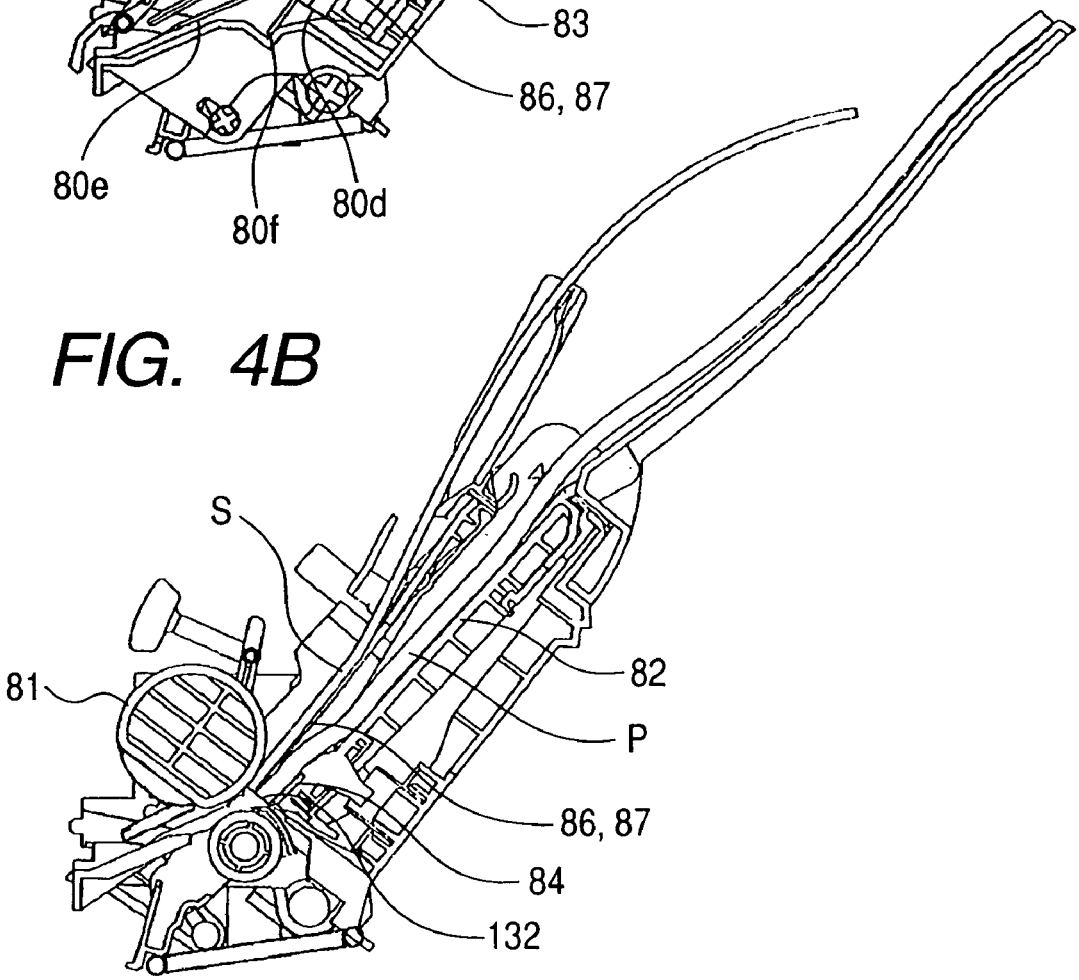
Figure 5B:
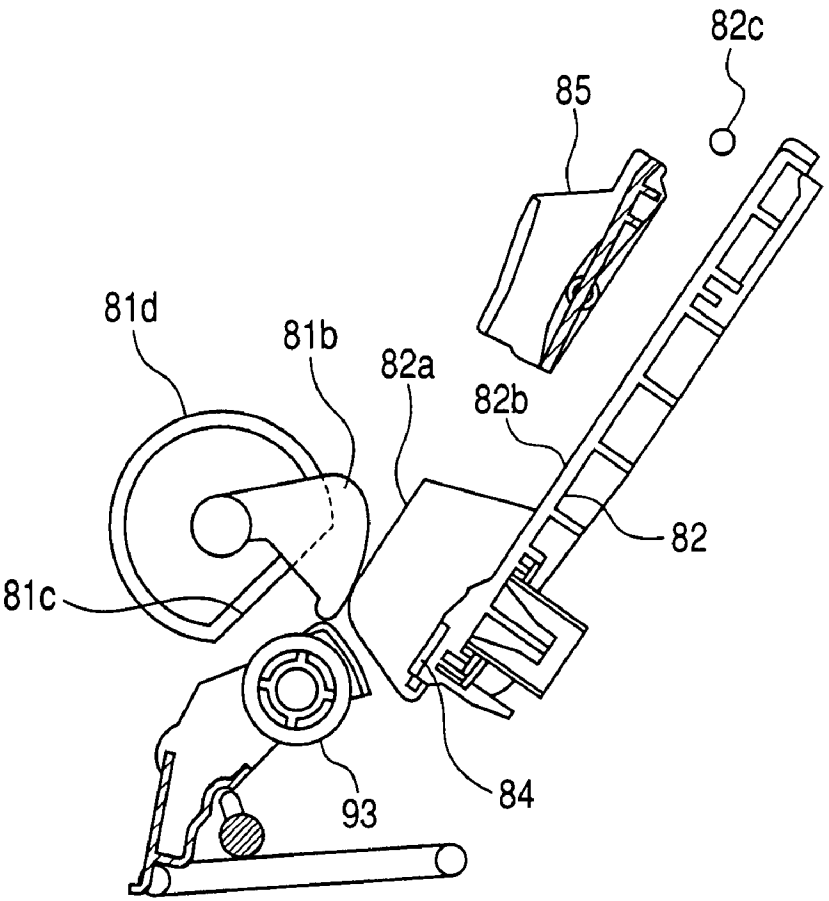
FIGS. 5A and 5B are schematic cross sectional views of the movement of a pressure plate and a feeding roller in the automatic feeder.
Figure 5A:
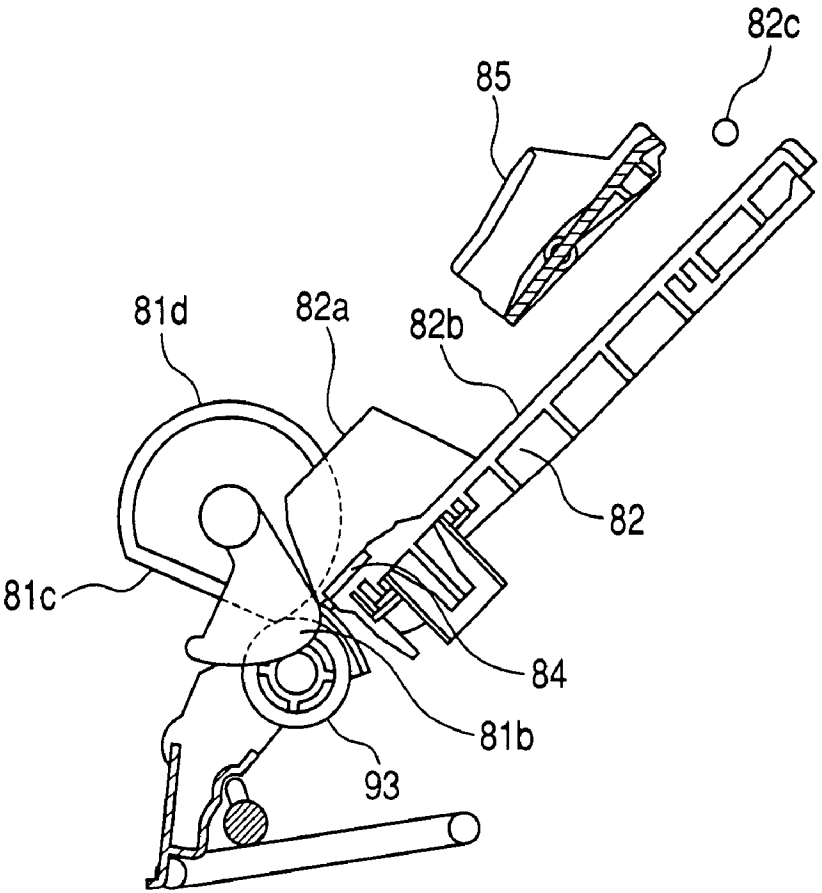
Figure 6A:
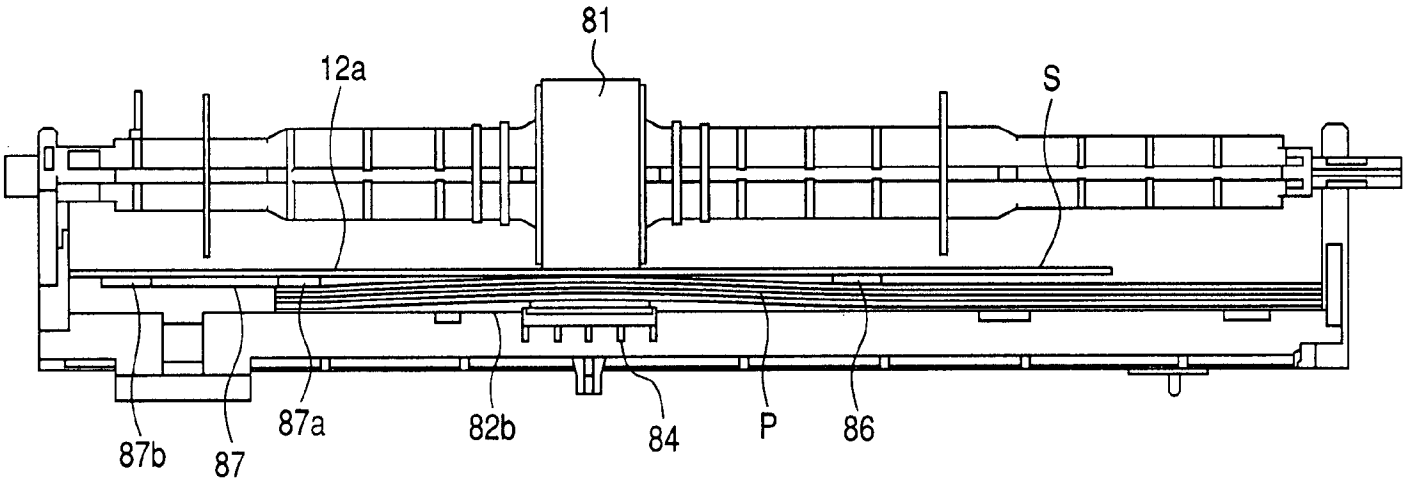
FIGS. 6A and 6B are front views for explaining the sheet feeding state.
Figure 6B:
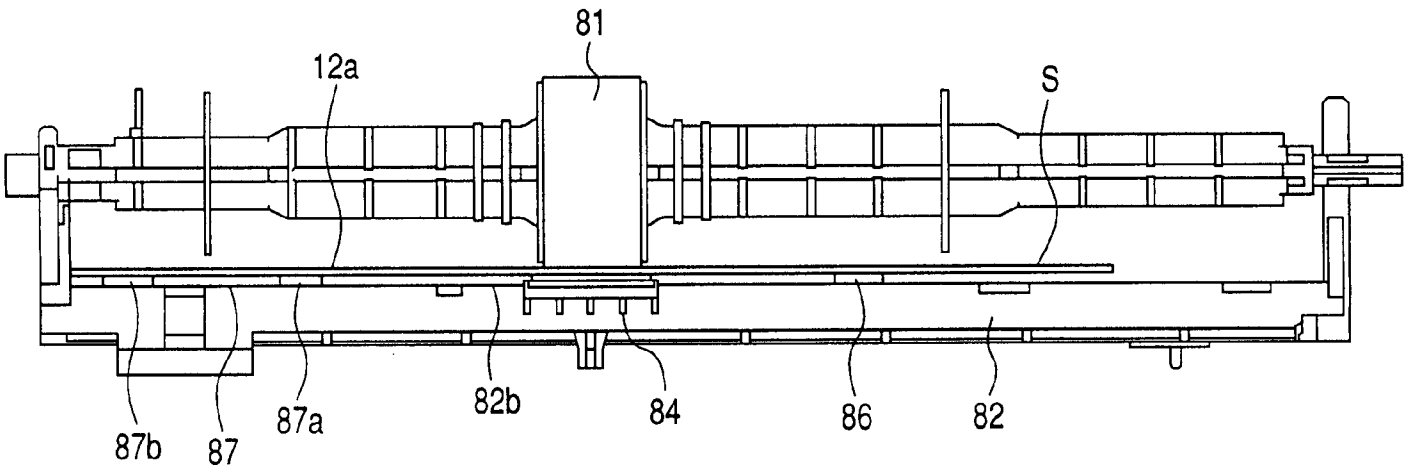
Figure 7:
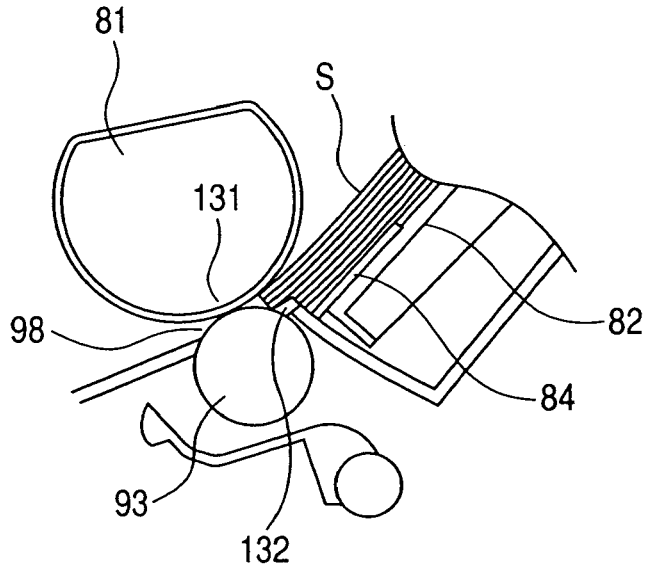
FIG. 7 is a schematic cross sectional view for explaining the separation mechanism of a separation unit.
Figure 8:
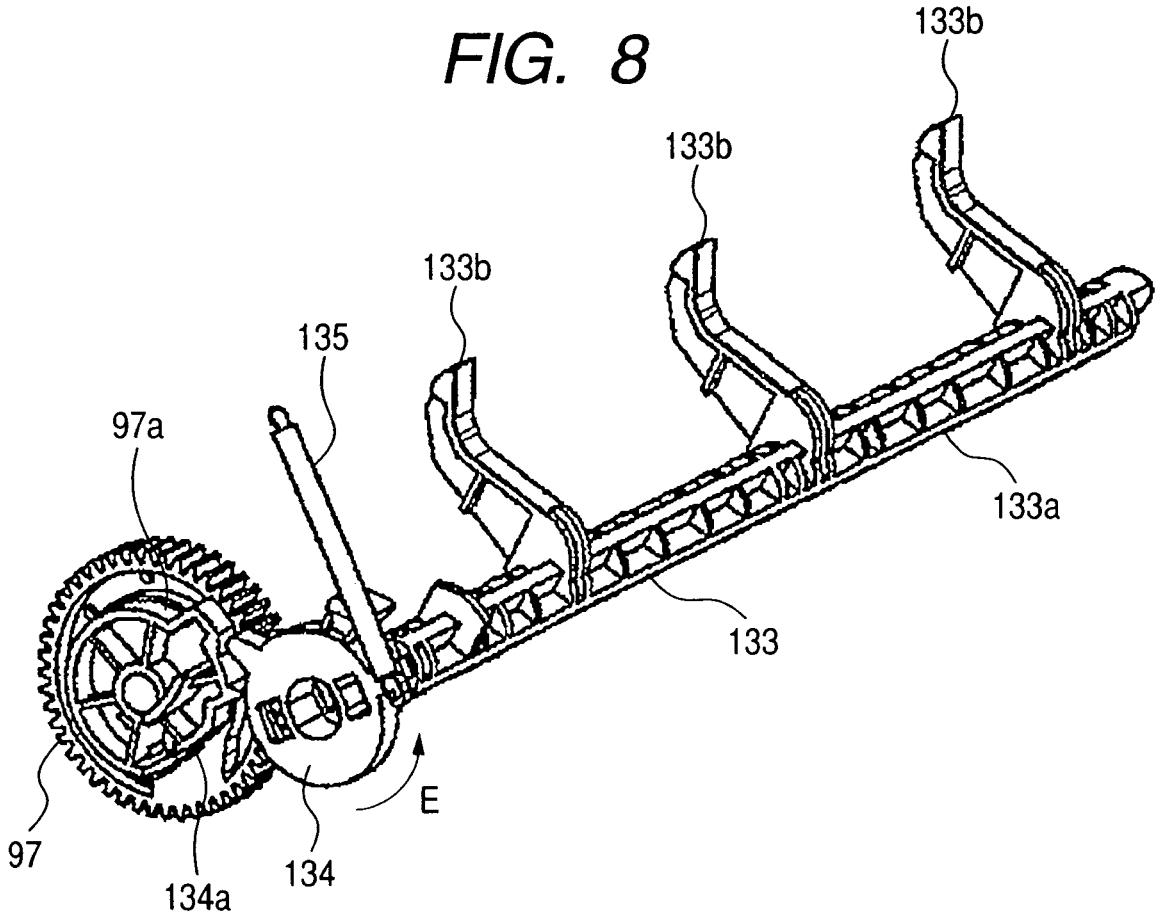
FIG. 8 is a perspective view of a returning pawl or a returning lever of an automatic feeder.

The automatic feeder 103 will now be described. FIG. 2 is a perspective view of the automatic feeder 103 wherein a document S and a recording medium P have not been set. FIG. 3 is a front view of the automatic feeder 103 wherein a document S and a recording medium P have not been set. FIGS. 4A and 4B are cross sectional views of the state of the automatic feeder 103 wherein only a document S has been set. FIGS. 5A and 5B are schematic cross sectional views showing the movements of the pressure plate and the feeding roller of the automatic feeder 103. FIGS. 6A and 6B are front views for explaining the state of the automatic feeder 103 during sheet feeding. FIG. 7 is a schematic cross sectional view for explaining the separation mechanism of a separation unit. FIG. 8 is a perspective view of the structure of the returning lever for the automatic feeder 103. And FIGS. 9A to 9C and FIG. 10 are cross sectional views for explaining the movement of the returning lever of the automatic feeder 103.

As shown in FIGS. 2 and 4A, the ASF base 80, which is the frame of the automatic feeder 103, is constituted by a base surface 80*a*, a right side plate 80*b*, a left side plate 80*c*, a leading end reference surface 80*d* and a sheet passage surface 80*e*.

The feeding roller 81 is rotatably attached, via a bearing, to the right side plate 80*b* and the left side plate 80*c*. A support shaft 82*c* of the pressure plate 82 is rotatably attached, via a bearing, to the right side plate 80*b* and the left side plate 80*c*. And the pressure plate 82 is urged toward the feeding roller 81 by a pressure plate spring 83 provided between the reverse face of the pressure plate 82 and the base surface 80*a* of the ASF base 80.

Further, as shown in FIGS. 2 and 5A and 5B, a drive cam 81*b* is fitted over the shaft of the feeding roller 81 and a driven cam 82*a* is provided for the pressure plate 82. As is shown in FIG. 5A, the pressure plate 82 functions as a pressing member that, during sheet feeding, presses the stack of recording medium P or the documents S toward the feeding roller 81 by using the force exerted by the pressure plate spring 83. Furthermore, as shown in FIG. 5B, during times other than during sheet feeding, the pressure plate 82 is pressed down by the driven cam 82*a*, so that a gap, for setting a document S and a recording medium P, is defined between the pressure plate 82 and the feeding roller 81 and the pressure plate 82 functions as recording medium stacking means. That is, as the feeding roller 81 is rotated, the pressure plate 82 is separated from or brought into contact with the feeding roller 81, and the drive cam 81*b* and the driven cam 82*a* constitute separation/contact means.

A sensor flag 81*a*, integrally formed with the shaft of the feeding roller 81, engages an ASF sensor (not shown) to identify the phase of the feeding roller 81. In cross section, the feeding roller 81 is a so-called D cut roller having an arc portion 81*d* and a linear portion 81*c*. The drive cam 81*b* and the semicircular phase of the feeding roller 81 are so designed that when the pressure plate 82 is separated from the feeding roller 81, a separation pad 84, a separation means example, is opposite the linear portion 81*c* (FIG. 4A), and when the pressure plate 82 is pushed forward, the pressure plate 82 contacts the arc portion 81*d* of the feeding roller 81 (FIG. 4B).

The separation pad 84 is adhered to the center of the leading end of the pressure plate 82, and in the urging state, during sheet feeding, the separation pad 84 and the feeding roller 81 are opposite each other. In addition, as shown in FIGS. 5A and 5B, the separation pad 84 projects slightly from the recording medium stacking face 82*b* toward the feeding roller 81. In this embodiment, the separation pad 84 projects a distance equivalent to the thickness of the maximum number of documents S stacked.

A separation roller 93, a separation means example, is arranged downstream from the nip portion between the feeding roller 81 and the separation pad 84, and abuts upon the feeding roller 81. The separation roller 93, including a torque limiter, receives a driving force in a direction opposite that of the conveying direction, and can be separated from and brought into contact with the feeding roller 81. As shown in FIG. 7, the automatic feeder 103 in this embodiment is separated into two separation sections: a front separation unit and a main separation unit 131. The front separation unit is constituted by the separation pad 84 of the pressure plate 82, the feeding roller 81 and a passage control wall 132. The passage control wall 132 is so formed that the gap defined in the passage section, between the feeding roller 81 and the ASF base 80, is about 1 mm. For example, when about fifty recording medium have been set, the passage control wall 132 separates these media, permitting several sheets to be conveyed to the main separation unit 131 each time a like number of sheets has been processed by the main separation unit 131. The main separation unit 131 is constituted by the feeding roller 81 and the separation roller 93, and separates the several sheets fed by the front separation unit using the above described processing. The second and following sheets to be separated and conveyed by the main separation unit 131 are held near a nip portion 98 between the separation roller 93 and the feeding roller 81.

A document table (a first stacking member) 85, which is a document stacking means example, is detachably connected to the pressure plate 82, above and parallel to the recording medium stacking surface 82*b* and at a predetermined interval. The document table 85 can be moved with the pressure plate 82. Therefore, when the pressure plate 82 is pivoted so as to be separated from or brought into contact with the feeding roller 81, accordingly, the document table 85 is rotated at the shaft 82*c*, so that the interval formed between the document table 85 and the pressure plate 82 is maintained. The document table 85 does not have a support portion at the position corresponding to the feeding roller 81, but includes a right document bridge 86 and a left document bridge 87, which are example document guide members (second stacking members), at positions whereat the feeding roller 81 is avoided.

The right document bridge 86 is fitted, at the rear end, to a support shaft 86*c*, so as to be vertically pivotable relative to the document table 85. Similarly, the left document bridge 87 is fitted, at the rear end, to a support shaft 87*c* so as to be vertically pivotable relative to the document table 85. The free distal ends of the right document bridge 86 and the left document bridge 87 are extended downstream, in the conveying direction, to locations in the vicinity of the feeding roller 81. While the document table 85 is attached to the pressure plate 82, the lower faces of the distal ends of the document bridges 86 and 87 are regulated by a recessed portion 80*f* of the ASF base 80, which is an example regulation portion. With this arrangement, a predetermined gap can be obtained between the document bridges 86 and 87 and the recording medium stacking face of the pressure plate 82 (FIG. 4A). The recessed portion 80*f* is formed in the leading end reference surface 80*d*, and the right document bridge 86 and the left document bridge 87 hold a document S until the document S reaches the leading end reference surface 80*d*. The upward rotation of the document bridges 86 and 87 is not restricted, and as will be described later, when a document S has not been set, the document bridges 86 and 87 are pushed by a recording medium P and are rotated upward further than the nip portion between the recording medium P and the feeding roller 81.

A recording medium tray 8 is attached to the ASF base 80 in order to extend the recording medium stacking face beginning at the pressure plate 82. Further, a document tray 88 is so fixed that it extends the document stacking face. A slip stop member 89 is provided at the distal end of the document tray 88 (the rear end in the conveying direction). The length supported by the document tray 88 and the document tray 85 is about ⅔ the size A4. When an A4 document is set, ⅓ of the rear end is free, and when the document is soft paper, as shown in FIG. 1, the weight of the paper causes it to drop down to the rear, so that the rear end is supported by the recording medium tray 8.

As shown in FIG. 3, a side guide 90 is attached to the pressure plate 82 to slide in a direction indicated by an arrow C, perpendicular to the direction in which the recording medium P is conveyed by the feeding roller 81. A document slider 30 is also attached to the document table 85 to slide in the direction indicated by the arrow C. When a recording medium P is to be set, the right side of the recording medium P abuts upon a recording medium crosswise direction reference surface 91 of the pressure plate 82 to adjust the crosswise direction, the left side of the recording medium P is controlled along a guide face 90*a* of the side guide 90, the leading end is supported along the leading end reference surface 80*d*, and the entire recording medium P is supported by the recording medium tray 8 and the recording medium stacking face 82*b* of the pressure plate 82 (FIGS. 1 and 3). When a document S is to be set, the left side of the document S abuts upon a document cross direction reference face 85*a* of the document table 85 to adjust the crosswise direction, the right side of the document S is regulated along a guide face 30*a* of the document slider 30, the leading end of the document S is supported along the leading end reference surface 80*d*, and the entire document S is supported by the document tray 88, the document tray 85 and the document bridges 86 and 87 (FIGS. 1, 3, 4A and 4B).

The recording medium cross section reference face 91 and the document cross direction reference face 85*a*, located on the left and right side of the apparatus, are shifted relative to each other about 30 mm in the crosswise direction. Therefore, when both a recording medium P and a document S are set, the recording medium P, even one having the maximum width, is not present under the document S within a range of about 30 mm from the reference side of the document S (FIG. 3). A sensor for detecting the presence or absence of the document S is arranged in an area wherein the recording medium P has not been set. This sensor is constituted by a photointerrupter and a DS actuator 92 that is rotatably supported by a holder (not shown). When a document S has been set, the document S is brought into contact with an arm 92*a* and the DS actuator 92 is rotated to turn on or off the photointerrupter (FIG. 1). The left document bridge 87 has distal forked ends that are located in the area wherein the documents S are stacked, and extend from the area whereat the recording medium are stacked to the area whereat the recording medium are not stacked. The arm 92*a* of the DS actuator 92 is moved at the root portion of the forked ends (FIG. 2).

When only the recording medium P have been set, the documents S are removed while in the state shown in FIG. 4A. When the feeding roller 81 is rotated, the pressure plate 82 is moved by the drive cam 81*b* in the direction in which the pressure plate 82 is pressed against the feeding roller 81 (FIG. 5B), and the feeding roller 81 contacts the topmost recording medium P. At this time, since the document bridges 86 and 87 are located above the recording medium P at the position in the cross direction whereat the feeding roller 81 is avoided, the document bridges 86 and 87 are retracted upward from the feeding roller 81 and do not interfere with the separation process (FIGS. 2 and 3).

When both the documents S and the recording medium P have been set, the apparatus is in the state shown in FIG. 4A. When the feeding roller 81 is rotated, the pressure plate 82 is moved by the drive cam 81*b* in the direction in which the pressure plate 82 is pressed against the feeding roller 81 (FIG. 5B), the documents S are pushed against through the recording medium P, and the topmost document S contacts the feeding roller 81. At this time, the document bridges 86 and 87 are pinched by the recording medium P and the documents S. However, as shown in FIG. 6A, since the separation pad 84 is projected from the recording medium stacking face 82*b*, and the document bridges 86 and 87 avoid the feeding roller 81 in the cross section, a predetermined biasing force is exerted between the document S and the feeding roller 81 with no extra displacement of the document S. Further, the recording medium P is not present under the document S within the range of about 30 mm on the reference side; however, since the document S is supported by the left document bridge 87, the document S does not drop downward. This is because, as is described above, the left document bridge 87 has forked ends, and one of the ends is placed on the recording medium P to regulate the position. Thus, the document S can be supported in accordance with a change in the number of the recording medium P that has been set.

When only documents S have been set, as shown in FIG. 6B, the documents S are pushed directly against the pressure plate 82, and the topmost document S is brought into contact with the feeding roller 81. At this time, the document bridges 86 and 87 are pinched between the pressure plate 82 and the documents S. However, since the separation pad 84 is projected from the recording medium stacking face 82*b*, the separation pad 84 and the document bridges 86 and 87 are substantially at the same height, and a predetermined biasing force is exerted on the document S and the feeding roller 81 with no extra displacement of the document S. Assume that the separation pad 84 and the recording medium stacking face 82*b* are at the same height. In this case, in order to press the document S against the feeding roller 81, the document S must be displaced in the crosswise direction a distance equivalent to the thickness of the document bridges 86 and 87. Then, the biasing force of the pressure plate 82 would be used only to displace the document S, while an appropriate biasing force would not be exerted against the feeding roller 81, and a paper feeding failure would occur.

As is described above, when a plurality of documents S and recording medium P are separated and conveyed by the separation roller 93 and the feeding roller 81, the second and following sheets are halted near the nip portion 98 between the separation roller 93 and the feeding roller 81. When sheets remain at this position, normal sheet feeding cannot be performed the next feeding time, or when additional sheets are set. Therefore, a sheet returning mechanism, for returning sheets at the nip portion 98 to the set position, is provided.

As shown in FIG. 8, the sheet returning mechanism includes: a returning lever 133, which is pivotally supported at the reverse side of the sheet passage face 80*e* of the ASF base 80, and a control cam 134, which uses a cam to operate the returning lever 133. The returning lever 133 includes a shaft 133*a* and a plurality of pawls 133*b*, and the control cam 134 is fitted to one end of the shaft 133*a*. The control cam 134 is urged by an urging spring 135 in a direction indicated by an arrow E, and by a driven portion 134*a* of the control cam 134 and a drive cam 97*a* of a control gear 97, which will be described later, the returning lever 133 obtains three positions shown in FIGS. 9A to 9C.

Figure 9A:
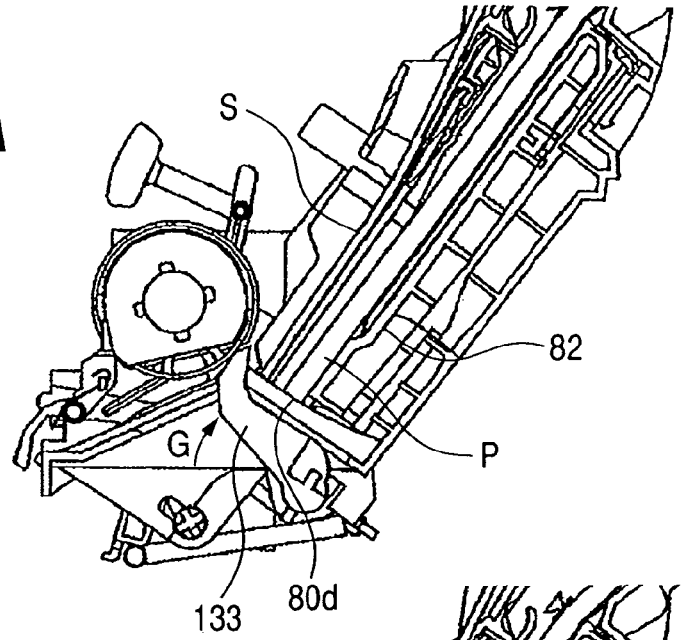
FIGS. 9A, 9B and 9C are cross sectional views for explaining the movement of the returning lever for the automatic feeder.

The position of the returning lever 133 shown in FIG. 9A is the one for the waiting state in the sheet feeding operation. In the waiting state, during the sheet feeding operation, the distal end of the returning lever 133 is inserted into the sheet passage route, and the returning lever 133 functions as a stopper, so that the leading edge of a recording medium P or a document S that has been set is prevented from erroneously, deeply entering the automatic feeder 103.

Figure 9B:
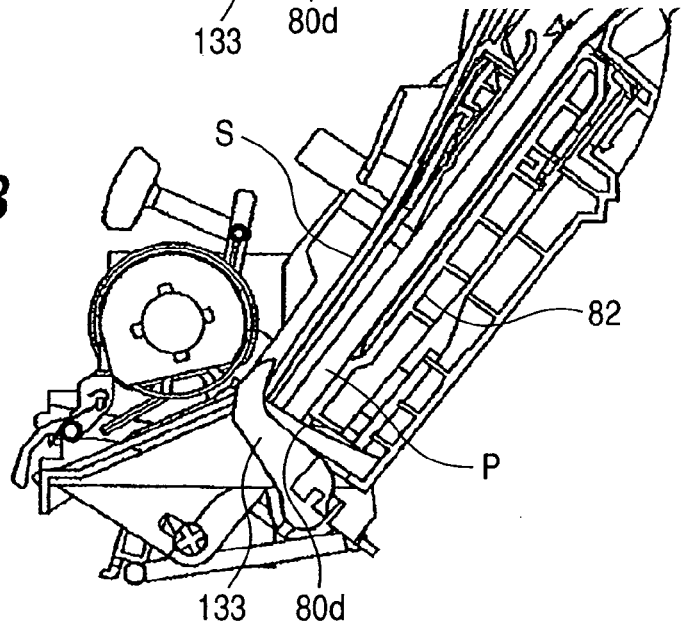

In FIG. 9B, the position shown for the returning lever 133 is the one it assumed after being rotated a little, from the position shown in FIG. 9A, in a direction indicated by an arrow G, and is in this state immediately after the sheet feeding operation was started and the sheet was returned from the nip portion to the set position. Since it is highly probable that new recording medium or documents might be stacked while the sheet feeding was in the wait state, immediately after the sheet feeding operation is started the leading end of the sheet is returned to the predetermined leading end reference surface 80*d*. When the returning lever 133 reaches this position (FIG. 9B), the leading end of the recording medium P or the document S that is being conveyed forward is completely returned to the leading end reference surface 80*d*.

Figure 10:
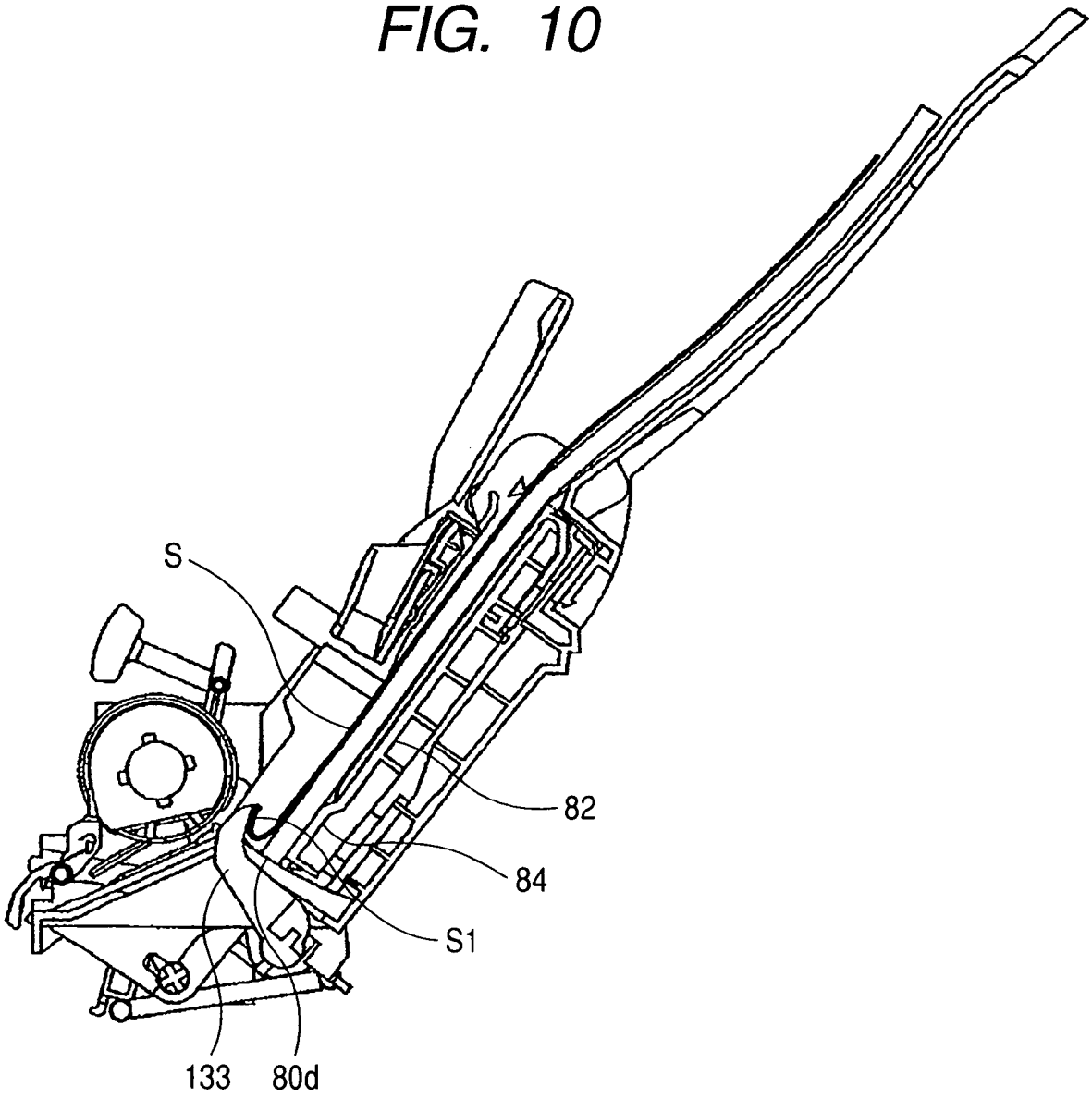
FIG. 10 is a cross sectional view for explaining the movement of the returning lever for the automatic feeder.
Figure 11:
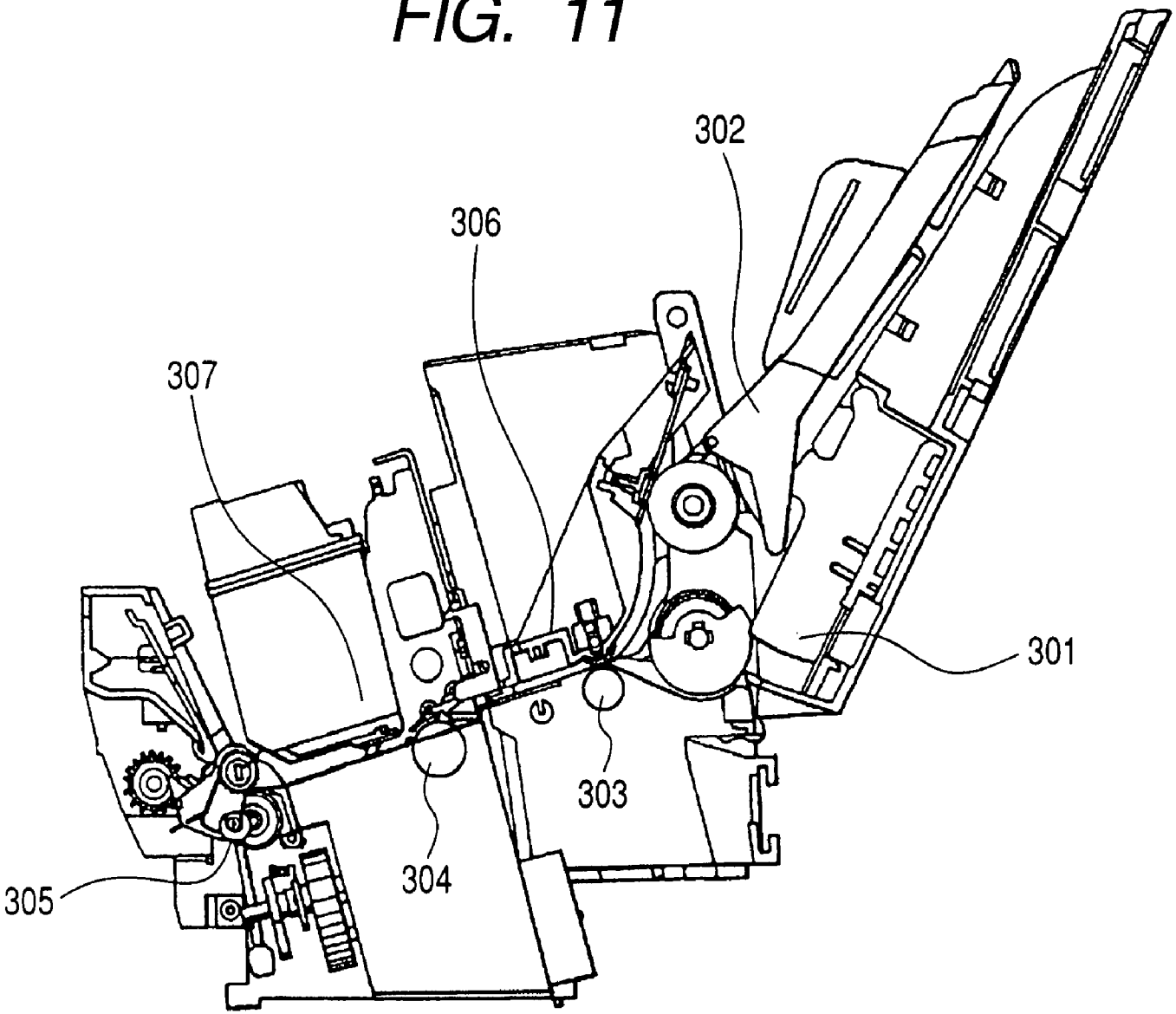
FIG. 11 is a diagram showing an example conventional image processing apparatus.

The recording medium P pinched at the nip portion between the feeding roller 81 and the separation roller 93 are returned to the set position, as the leading ends are pushed by the returning lever 133. However, at this time, since the recording medium P are stacked upright at 45° or greater, the recording medium P are pushed obliquely upward against their own weight. When the strength of the recording medium P is not appropriate, the recording medium P may not be shifted upward, and as shown in FIG. 10, only the leading end S1 of the document S would be returned, so that the recording medium P would be bent as though it were curled. Since it is assumed that the recording medium P used for the apparatus in this embodiment has a thickness of about 100 μm, the recording medium P are returned to the set position without having been bent along the way. However, thin sheets having a thickness of about 60 μm, such as slips, may be used as the documents S, and when such documents S are returned by the returning lever 133, the documents S would be bent as described above when space downward is present. Thus, in this embodiment, a sheet passage face for restricting the downward space is formed by the document bridges 86 and 87, so that thin sheets can also be returned to the set position without being bent.

Figure 9C:
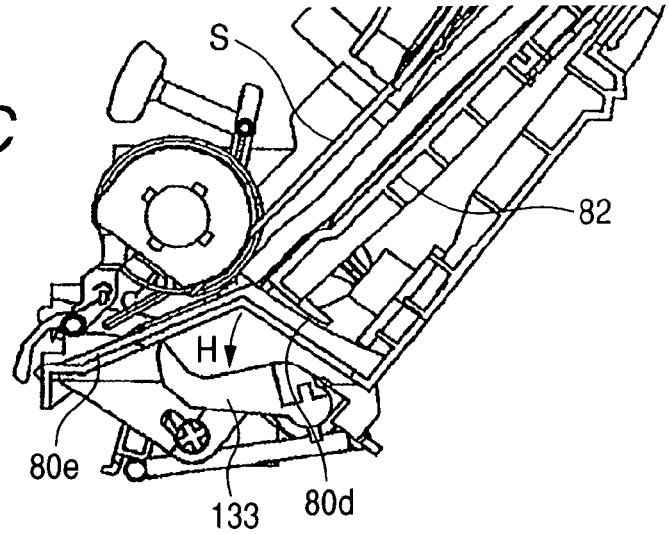

In the state shown in FIG. 9C, the driven portion 134*a* of the control cam 134 is disengaged from the drive cam 97*a* of the control gear 97 (see FIG. 8). The returning lever 133 is rotated, in the direction indicated by an arrow H, by the biasing force of the urging spring 135, and is completely retracted from the sheet passage face so as not to catch the sheet.

As is described above, according to the present invention, the feeding roller, for feeding documents or the recording medium from the document stacking means or the recording medium stacking means, the separation unit, for interacting with the feeding roller to separate the documents or the recording medium, and the conveyance path, along which the document and the recording medium are passed, are provided. Therefore, the configuration of the apparatus is employed in common, and the size and the cost of the apparatus can be reduced.

Especially since the document stacking means is attached substantially parallel to the recording medium stacking means, at a predetermined interval, a predetermined gap can still be maintained when the recording medium stacking means is pressed against the feeding roller. Therefore, pinching of the recording medium by the document stacking means can be prevented, and the occurrence of back tension during and after the sheet feeding can be avoided.

Further, according to the above-described arrangement, when the recording medium are set, the documents are pushed against the feeding roller, through the recording medium, by the pressure plate. At this time, since the recording medium are not present below the documents within a range of about 30 mm on the reference side of the document, if the end of the document is curled down, the document can not pass across the leading end reference face, and erroneous feeding or skew feeding occurs. However, according to this invention, even in an area wherein the recording medium are not present, the lower face of the document is supported by the document guide member, and the document does not drop downward. Since the document guide member is so arranged that it extends from the area whereat the recording medium are present to the area whereat the recording medium are not present, the document can be supported at the same height as the recording medium that have been set. Therefore, the documents can be set stably, and a feeding failure, such as erroneous feeding or skew feeding, can be prevented.

Furthermore, since the document guide member is vertically rotatable, the documents can be supported in accordance with a change in the number of recording medium that have been stacked, so that the documents can be stably guided. In addition, with the arrangement wherein documents are stably stacked, thin documents can be precisely returned to the set position by the returning lever, without being bent.

This application claims priority from Japanese Patent Application No. 2004-184537 filed on Jun. 23, 2004, which is hereby incorporated by reference herein.

What is claimed is:

1. An image processing apparatus comprising:

a recording medium stacking portion for stacking recording medium, said recording medium stacking portion being rotatable with respect to a base member;

a document stacking portion provided rotatable with respect to said recording medium stacking portion to stack documents, said document stacking portion being rotatable in synchronism with the rotation of said recording medium stacking portion;

a feeding roller for feeding the documents stacked on said document stacking portion or the recording medium stacked on said recording medium stacking portion;

an image reading portion for reading an image of the document;

a document guide provided rotatable with respect to said document stacking portion downstream of said document stacking portion in a conveying direction of the documents and located between the documents stacked on said document stacking portion and the recording medium stacked on said recording medium stacking portion, said document guide being located at a position where said document guide is not in contact with said feeding roller in a widthwise direction of said document; and a regulation portion provided on said base member to regulate the rotation of said document guide, wherein said regulation portion is in contact with a side opposite to a surface with which the document of said document guide is in contact so that the document guide maintains a predetermined distance from the recording medium stacking portion.

2. An image processing apparatus according to claim 1, wherein references in crosswise directions for the document stacking portion and the recording medium stacking portion are one-side references, and a reference surface of the document stacking means and a reference surface of the recording medium stacking portion are set on opposite sides of the image processing apparatus; wherein an interval between the reference surface of the document stacking portion and the reference surface of the recording medium stacking portion is defined so as to be greater than the width of the maximum sized recording medium conveyed by the image processing apparatus; and wherein the document guide is located in an area wherein documents are stacked and extends from an area wherein recording medium are stacked to an area wherein recording medium are not stacked.

3. An image processing apparatus according to claim 1, wherein said regulation portion is a recessed portion provided on said base member.

4. An image processing apparatus according to claim 1, wherein the document stacking portion includes a first stacking member integrally attached to the recording medium stacking portion, and a predetermined interval is defined between the first stacking member and a stacking face of the recording medium stacking portion.

5. An image processing apparatus according to claim 4, wherein the first stacking member is moved with the recording medium stacking portion that is rotated by rotating means.

6. An image processing apparatus according to claim 4, wherein the first stacking member includes a second stacking member that is located at a distance from the document guide and that supports the document between the first stacking member and the document guide.

7. An image processing apparatus according to claim 6, wherein one end of the second stacking member is supported so as to be slidable along the first stacking member, and the other end of the second stacking member engages the recessed portion formed in the document guide.

8. An image processing apparatus according to claim 7, wherein the second stacking member is located at a position that is not opposite the feeding roller, so that the feeding roller can contact the recording medium stacked on the recording medium stacking portion.

9. An image processing apparatus according to claim 8, wherein, as the second stacking member is pushed and moved by the recording medium stacking portion, the documents are pressed against the feeding roller.

10. An image processing apparatus according to claim 9, wherein, as the second stacking member is pushed and moved by the recording medium stacked on the recording medium stacking means, the documents are pressed against the feeding roller.

11. An image processing apparatus according to claim 9, wherein the second stacking member is disengaged from the recessed portion when being moved.

* * * * *